US011655600B2

(12) United States Patent
Zhang et al.

(10) Patent No.: US 11,655,600 B2
(45) Date of Patent: May 23, 2023

(54) METHOD FOR INSTALLING STEEL TUBE ARCHES

(71) Applicants: China Railway No.3 Engineering Group Co.Ltd, Shanxi (CN); The Second Engineering Co.Ltd of the Third Engineering Group of China Railway, Hebei (CN)

(72) Inventors: Yugen Zhang, Shanxi (CN); Chenghong Liu, Shanxi (CN); Liang Ma, Shanxi (CN); Yubo Chen, Shanxi (CN); Changyong Ji, Shanxi (CN); Yingmei Wang, Shanxi (CN); Boxuan Zhang, Shanxi (CN); Guoying Song, Shanxi (CN); Tengfei Dong, Shanxi (CN)

(73) Assignee: China Railway No.3 Engineering Group Co.Ltd, Taiyuan (CN)

( * ) Notice: Subject to any disclaimer, the term of this patent is extended or adjusted under 35 U.S.C. 154(b) by 254 days.

(21) Appl. No.: 17/168,177

(22) Filed: Feb. 5, 2021

(65) Prior Publication Data

US 2021/0164176 A1 Jun. 3, 2021

Related U.S. Application Data

(63) Continuation of application No. PCT/CN2020/128419, filed on Nov. 25, 2020.

(51) Int. Cl.
*E01D 21/00* (2006.01)
*E01D 4/00* (2006.01)

(52) U.S. Cl.
CPC ..... *E01D 21/00* (2013.01); *E01D 4/00* (2013.01)

(58) Field of Classification Search
CPC ..... E01D 4/00; E01D 21/00
(Continued)

(56) References Cited

U.S. PATENT DOCUMENTS 3,374,497 A * 3/1968 Meheen ..... E01D 21/06 52/749.1
4,497,153 A * 2/1985 Muller ..... E01D 21/00 52/745.2

(Continued)

FOREIGN PATENT DOCUMENTS

CN 1851137 A 10/2006
CN 104562936 A 4/2015

(Continued)

*Primary Examiner* — Raymond W Addie

(57) ABSTRACT

The disclosure relates to the technical field of bridge construction, in particular to a method for installing steel tube arches, which comprises the following steps: step S1, erecting steel tube arch assembling brackets; step S2, assembling a steel tube arch of longitudinally moving segment; step S3, installing temporary tie rods; step S4, dismantling the assembling brackets; step S5, longitudinally moving the steel tube arch of longitudinally moving segment; step S6, erecting an arch springing bracket and assembling small mileage arch springing segments; step S7, closing the steel tube arch; S8, arch falling and temporary auxiliary facilities dismantling; step S9, construction of concrete and suspenders in arch. The method for installing steel tube arches provided by the disclosure is safe, standardized and reliable, and the construction standard is prone to control.

10 Claims, 10 Drawing Sheets

(58) Field of Classification Search
USPC ..... 14/24–26, 77.1
See application file for complete search history.

(56) References Cited

U.S. PATENT DOCUMENTS 5,511,268 A * 4/1996 Albus ..... E01D 21/06 212/312
5,947,308 A * 9/1999 Markelz ..... B66C 17/00 104/2
6,721,985 B2 * 4/2004 McCrary ..... B60L 3/0046 212/315
8,671,490 B1 * 3/2014 Carney ..... B66C 13/04 14/2.4
2003/0217420 A1 * 11/2003 Snead ..... E01D 22/00 14/77.1
2004/0111815 A1 * 6/2004 Fuessinger ..... E01D 15/133 14/77.1
2004/0148717 A1 * 8/2004 Kornatsky ..... E01D 1/00 14/77.1
2007/0163058 A1 * 7/2007 Homsi ..... E01D 21/06 14/77.1
2013/0055512 A1 * 3/2013 Liu ..... E01D 21/06 414/467

FOREIGN PATENT DOCUMENTS

CN 109914266 A 6/2019
CN 110205938 B 9/2019
CN 111636306 A 9/2020
CN 112359730 A 2/2021

* cited by examiner

METHOD FOR INSTALLING STEEL TUBE ARCHES

CROSS REFERENCE TO RELATED APPLICATION

This application is a U.S. National Stage Entry of PCT Application with No. PCT/CN2020/128419, filed on Nov. 12, 2020.

FIELD OF TECHNOLOGY

The disclosure relates to the technical field of bridge construction, in particular to a method for installing steel tube arches.

BACKGROUND

With the rapid development of economy and society, especially the acceleration of urbanization, the bottom-bearing beam-arc composite bridge with steel tube arch, as a bridge across existing roads, railways, valleys and rivers, has the advantages of saving materials and large span, and has been widely used. In the construction process of this kind of bridge, the installation and construction method of the steel tube arch directly affects the construction quality, construction efficiency and safety of the bridge. Upon search, the Chinese patent document with the authorized publication number of CN110205938B discloses a method for installing steel tube arches of bottom-bearing beam-arch composite bridge, including embedding a first arch support, a vertical hinged support, a low bracket base, a fixed pedestal, a girder surface track and a notch steel bar of the second arch support; erecting a temporary low support; assembling a first group of steel tube arch ribs and a second group of steel tube arch ribs to form a middle hinge; making the first group of steel tube arch ribs and the vertical hinged support form a first hinge, and the second group of steel tube arch ribs and a moving trolley form a second hinge; connecting the moving trolley and the tensioning device arranged on the fixed pedestal with a steel strand; starting the tensioning device to pull the moving trolley to make the second group of steel tube arch ribs move horizontally along the track on the girder surface, and gradually arching the first group of steel tube arch ribs and the second group of steel tube arch ribs at the middle hinge until the vault reaches the design position; consolidating and pouring the second group of steel tube arch ribs and the notch steel bar; dismantling temporary facilities, installing inlaying segments at the middle hinge and the first hinge, and filling them with pumped concrete.

SUMMARY

The design for existing steel tube arch installation process is unreasonable, the construction operation is cumbersome and difficult, the construction period is long, the number of difficult operations is large, the safety risk is high, and construction accidents are prone to occur, so it is necessary to improve the design. The present disclosure provides a method for installing steel tube arches, comprising the following technical solutions:

A method for installing steel tube arches comprises the following steps:

step S1, erecting steel tube arch assembling brackets for a steel tube arch of longitudinally moving segment;

step S2, assembling the steel tube arch of longitudinally moving segment;

(1) assembling small steel tube arch segments into installation segments;

(2) installing arch springing longitudinally moving trolleys on both sides of the steel tube arch of longitudinally moving segment;

(3) using two truck cranes to symmetrically assemble the installation segments according to a sequence from the arch springing to vault;

step S3, installing temporary tie rods of the steel tube arch of longitudinally moving segment and stretching to form a temporary tied arch structure;

step S4, dismantling the assembling brackets symmetrically from middle to both sides;

step S5, longitudinally moving the steel tube arch of longitudinally moving segment:

(1) after a closure of continuous girder of the main bridge, laying and installing a longitudinally moving track and debugging a longitudinal jack system;

(2) using jacks to smoothly and continuously push the steel tube arch of longitudinally moving segment to a designed lifting position of a main span;

step S6, erecting arch springing brackets and assembling small mileage arch springing segments;

(1) using a tower crane to erect small mileage arch springing brackets;

(2) pouring arch springing concrete;

step S7, closing a steel tube arch:

(1) continuously measuring a dimension of closure opening;

(2) matching and cutting a steel tube arch of inlaying segment according to measured data;

(3) completing closure construction of the steel tube arch at a closure temperature;

step S8, arch falling, unloading the temporary tie rods in stages, and dismantling the arch springing longitudinally moving trolleys;

step S9, performing construction of concrete and suspenders in the steel arches:

(1) pumping and injecting arch rib concrete with pressure according to a sequence of upper chord first, then lower chord, then web plate;

(2) installing long suspenders first and then installing short suspenders, and tensioning the suspenders.

In some embodiments, assembling small steel tube arch segments into installation segments in step 2, and then installing arch springing longitudinally moving trolleys on both sides of the steel tube arch of longitudinally moving segment; because the installation segments are symmetrically assembled by two truck cranes according to a sequence from arch springing to vault, so the arch springing longitudinally moving trolleys need to be fixed, which comprises: laying wheels of arch springing longitudinally moving trolleys on a track, the track is laid on pile foundations, attaching inclined frames of the arch springing longitudinally moving trolleys to bottoms of arch springing, and the arch springing is fixed on the inclined frames through arch springing fixing bolts;

lifting sliding plate: starting a drive motor to drive a worm gear and a winding reel to rotate through a worm, the winding reel rotates to wind up a steel wire rope, the steel wire rope lifts the sliding plate by pulling a movable pulley;

lifting the inclined frame and the arch springing: starting a control power supply to transmit current to a piston rod through a line, the piston rod moves to drive a crossed lifting rod to move, the sliding plate lifts the inclined frame and the arch springing through the supporting rod and a crossed hoisting device; the crossed hoisting device comprises the crossed lifting rod and the piston rod, the piston rod is arranged on the crossed lifting rod; also comprises the control power supply, which is arranged at a bottom of an inner side of the vehicle body, and one end of the piston rod is connected with the control power supply through a line, the crossed hoisting device is arranged at the bottom and middle section of the sliding plate and is fixedly connected with an inner bottom of the vehicle body;

fixing height of the sliding plate: when the arch springing reaches a predetermined height, stopping pulling the movable pulley and the crossed hoisting device;

moving position of the arch springing: starting a servo motor to drive a plurality of groups of sprockets to rotate through a chain, the sprockets further drives the wheels to travel on the track;

when the arch springing is lifted to a predetermined position, a balancing rod in a stabilizing device extends, and then a fixing rod provided on it extends until a fixing seat provided at one end of the fixing rod contacts the ground, so that the vehicle body is balanced and stabilized on the ground; the stabilizing device is arranged on the outside of the vehicle body, comprising a fixed base and a balancing rod arranged on the fixed base, one end of the balancing rod is movably connected with the fixed base, the other end of the balancing rod is movably connected with a fixing rod, and one end of the fixing rod is provided with a fixing seat, the balancing rod moves circularly around the fixed base and the balancing rod has a zigzag structure, and the fixing rod is placed inside the balancing rod when retracted;

The method for installing steel tube arches provided by the disclosure is safe, standardized and reliable, and the construction standard is prone to control. the arch springing longitudinally moving trolley used in the present disclosure is easy to operate and save labor cost.

The present disclosure also provides an arch springing longitudinally moving trolley for steel tube arch installation, the arch springing longitudinally moving trolley comprises a vehicle body, a supporting device above the vehicle body, a lifting device inside the vehicle body, a crossed hoisting device, a walking device under the vehicle body, a drive motor and a servo motor, the drive motor drives the lifting device to lift, the lifting device further drives the supporting device to lift to support the arch springing, the crossed hoisting device is used to support the lifting device, and the servo motor is used to drive the walking device moving further to drive the vehicle body;

the lifting device comprises a sliding plate, a fixed pulley, a movable pulley configured in the vehicle body, two ends of the sliding plate are inlaid with balls which are in rolling contact with the inner wall of the vehicle body, two ends of the bottom of the sliding plate are fixedly connected with a plurality of brackets, and the bottom ends of the brackets are movably abutted with the inner bottom of the vehicle body; the fixed pulley is fixedly connected with a top of the inner side of the vehicle body, several movable pulleys are fixedly connected with the bottom of the sliding plate, and the several movable pulleys and the fixed pulley are wound with an identical steel wire rope; one end of the steel wire rope is fixedly connected to the inner wall of the vehicle body; the drive motor is connected with the steel wire rope with a power transmission module;

the power transmission module comprises a worm fixedly connected with an output shaft of the drive motor, a worm gear and a winding reel rotatably connected with an inner top of the vehicle body, the winding reel is fixedly connected to a front side of the worm gear, and the worm is engaged with the worm gear; the other end of the steel wire rope is wound and fixedly connected to the winding reel;

the supporting device comprises an inclined frame, a top side of the inclined frame is screwed with a plurality of arch springing fixing bolts, a bottom of the inclined frame is fixedly connected with a plurality of support rods, and bottom ends of the support rods extend to the middle part of the inner side of the vehicle body and are fixedly connected with the sliding plate;

the crossed hoisting device comprise a crossed lifting rod and a piston rod arranged on the crossed lifting rod; a control power supply is arranged at a bottom of the inner side of the vehicle body, and one end of the piston rod is connected with the control power supply through a line; the crossed hoisting device is arranged at the bottom and middle section of the sliding plate and is fixedly connected with the inner bottom of the vehicle body;

the walking device comprises a traveling frame, the traveling frame is fixedly connected to both sides of the bottom of the vehicle body, a plurality of sets of wheels are rotatably connected to the traveling frame; the servo motor is fixedly connected to the bottom of the vehicle body, sprockets are arranged on the front end of the wheels, the front side of the traveling frame and the output shaft of the servo motor, and the wheels are coaxially driven with the corresponding sprockets; the front side of the travelling frame is rotatably connected with the corresponding sprocket; the output shaft of the servo motor is fixedly sleeved with the corresponding sprockets, and an identical chain is drivingly connected to a plurality of groups of sprockets;

the arch springing longitudinally moving trolley further comprises a stabilizing device, the stabilizing device is arranged on the outside of the vehicle body, the stabilizing device comprises a fixed base and a balancing rod arranged on the fixed base, one end of the balancing rod is movably connected with the fixed base, the other end of the balancing rod is movably connected with a fixing rod, and one end of the fixing rod is provided with a fixing seat.

Figure 1:
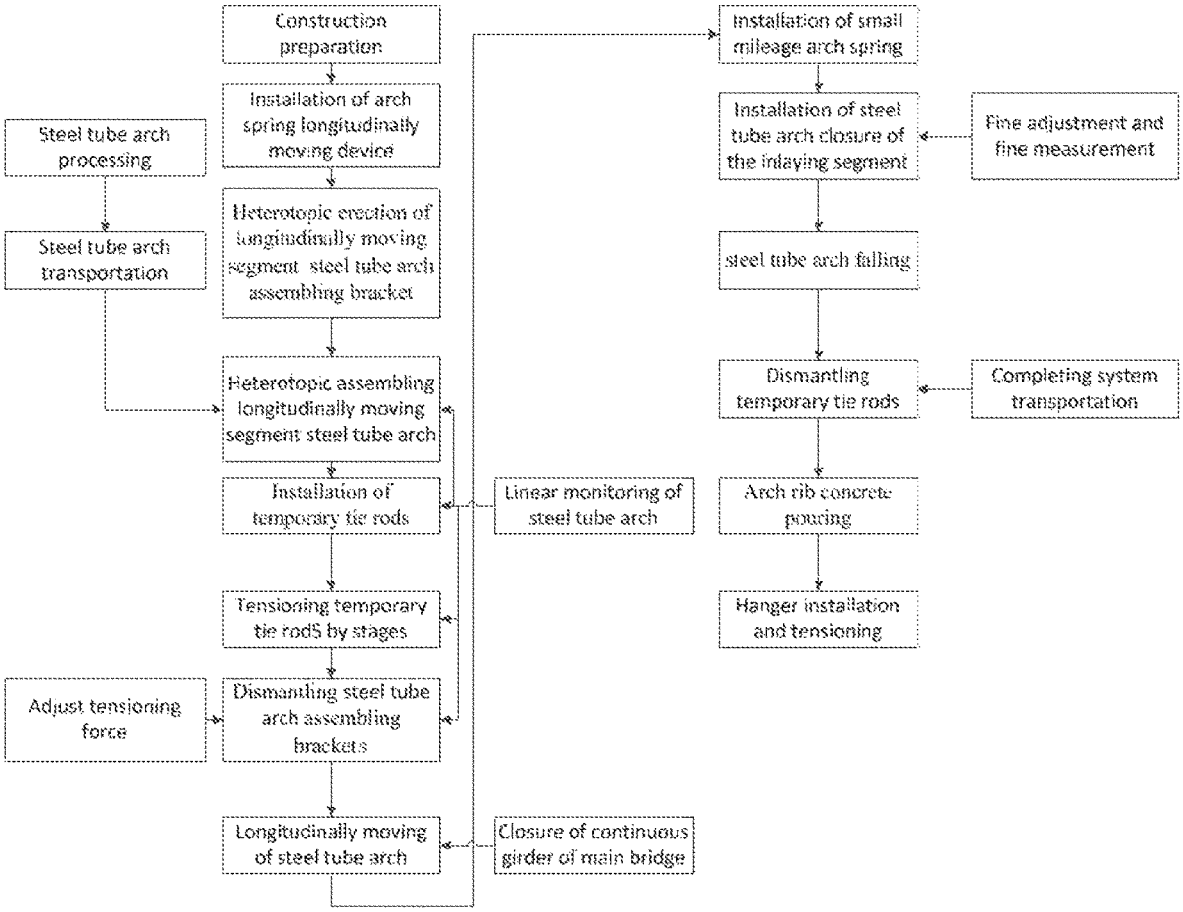
FIG. 1 shows a flow block diagram of the steel tube arch installation construction process according to the method for installing steel tube arches provided by the disclosure.

Description of reference signs in the drawings: 101. supporting device; 102. lifting device; 103. walking device; 104. stabilizing device; 105. power transmission module; 106. arch springing longitudinally moving trolley; 1. vehicle body; 2. inclined frame; 3. arch springing fixing bolts; 4. support rods; 5. sliding plate; 6. fixed pulley; 7. movable pulley; 8. steel wire rope; 9. drive motor; 10. worm; 11. worm gear; 12. winding reel; 13. travelling frame; 14. wheels; 15. servo motor; 16. sprocket; 17. chain; 18. bracket; 19. ball; 20. crossed hoisting device; 201. crossed lifting rod; 202. piston rod; 203. control power supply; 21. fixed base; 22. balancing rod; 23. fixing rod; 24. fixing seat; 25. temporary tie rod; 26. steel tube arch of longitudinally moving segment; 261. assembling bracket; 262. arch springing bracket; 263. small mileage arch springing segment; 27. steel tube upright post; 28. support plate; 29. stiffening plate; 30. steel bars; 31. braces; 32. backing plate; 33. tray; 34. spandrel girder; 35. diagonal bracing; 36. connecting plate; 37. box girder; 38. upper chord; 39. lower chord; 40. web plate; 41. suspender.

DESCRIPTION OF THE EMBODIMENTS

The technical solution in some embodiments of the disclosure will be described clearly and completely with reference to the drawings corresponding to the embodiments. Obviously, the described embodiments are only part of the embodiments of the disclosure, not the whole.

Figure 2:
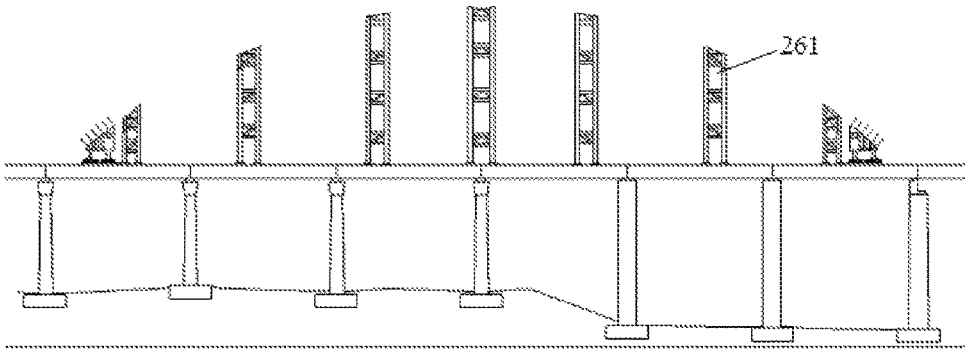
FIG. 2 shows a schematic diagram of the construction of erecting the steel tube arch assembling brackets according to the method for installing steel tube arches provided by the disclosure.
Figure 3:
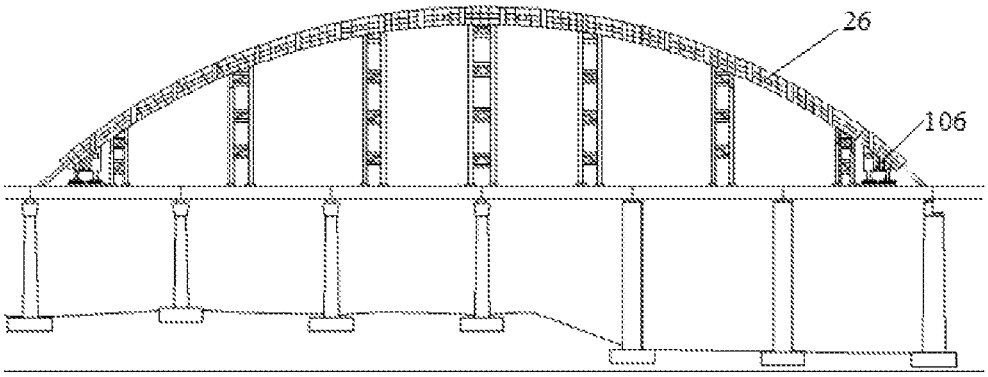
FIG. 3 shows a schematic diagram of the construction of assembling the steel tube arch of longitudinally moving segment according to the method for installing steel tube arches provided by the disclosure.
Figure 4:
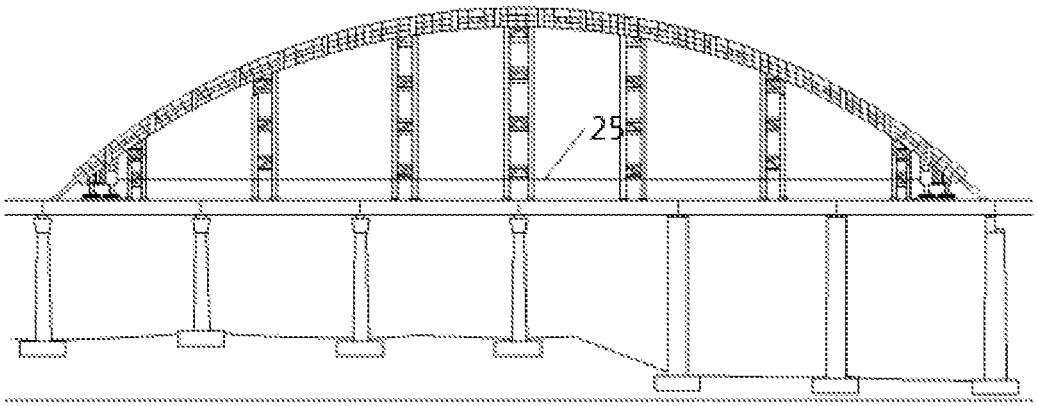
FIG. 4 shows a schematic diagram of the construction of installing temporary tie rods according to the method for installing steel tube arches provided by the disclosure.
Figure 5:
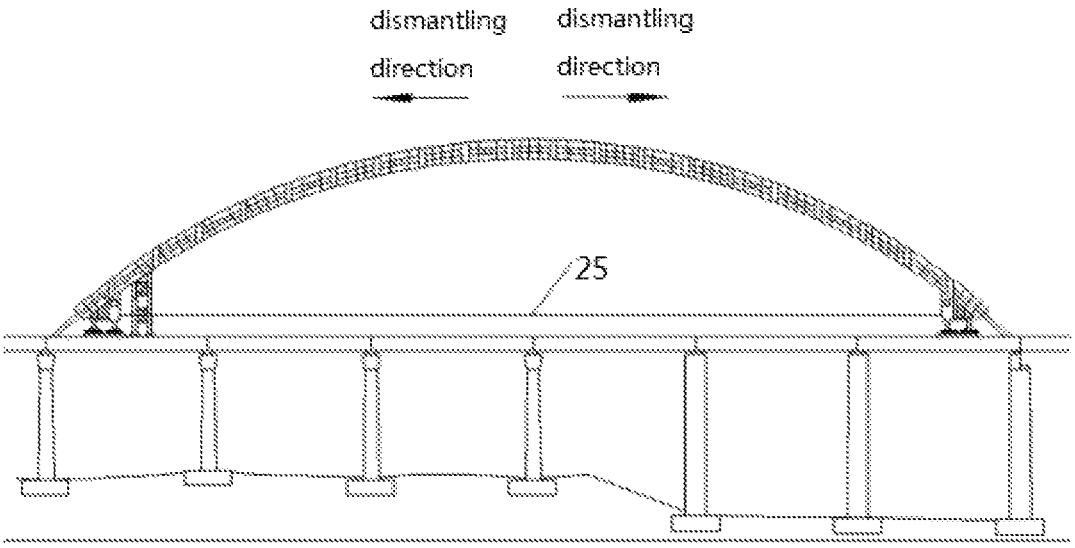
FIG. 5 shows a schematic diagram of the construction of dismantling the assembling brackets according to the method for installing steel tube arches provided by the disclosure.
Figure 6:
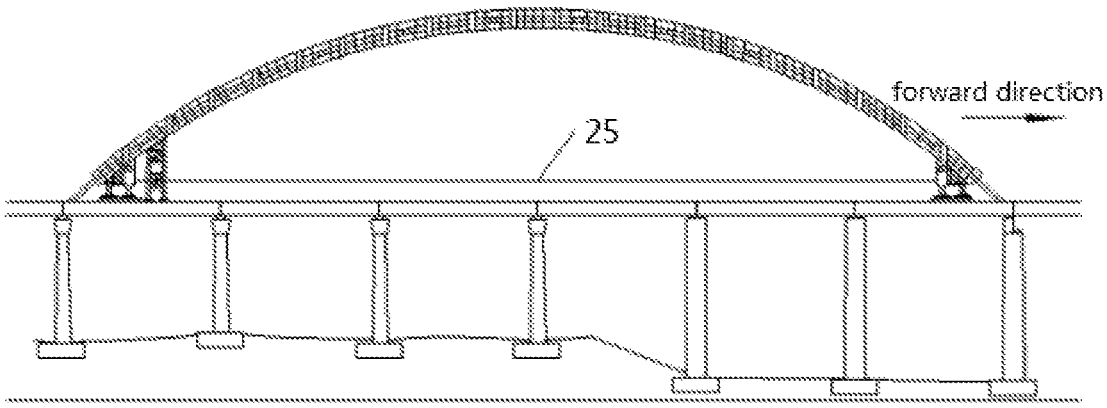
FIG. 6 shows a first schematic diagram of the construction of the steel tube arch of longitudinal movement according to the method for installing steel tube arches provided by the disclosure.
Figure 7:
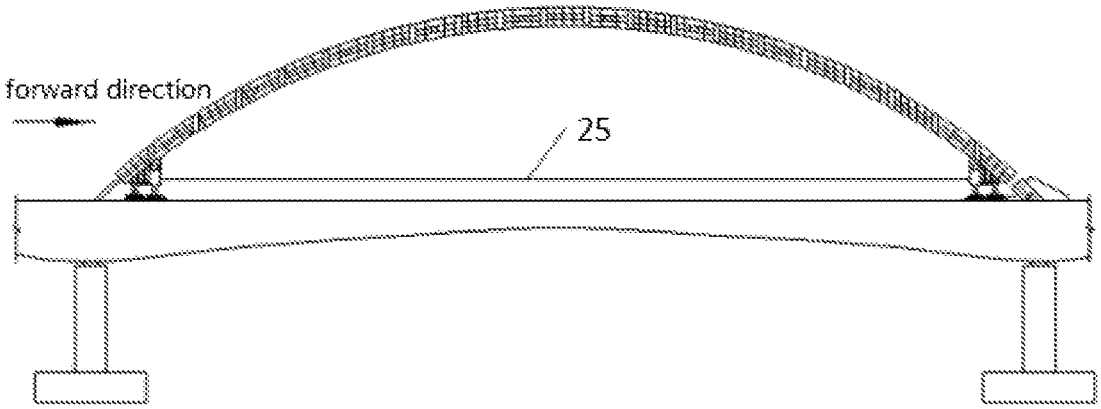
FIG. 7 shows a second schematic diagram of the construction of the steel tube arch of longitudinal movement according to the method for installing steel tube arches provided by the disclosure.
Figure 8:
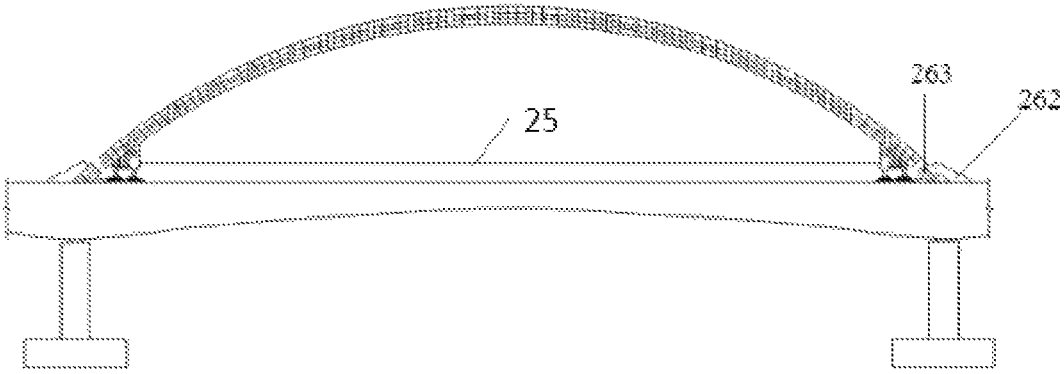
FIG. 8 shows a schematic diagram of the construction of erecting arch springing brackets and assembling small mileage arch springing segments according to the method for installing steel tube arches provided by the disclosure.
Figure 9:
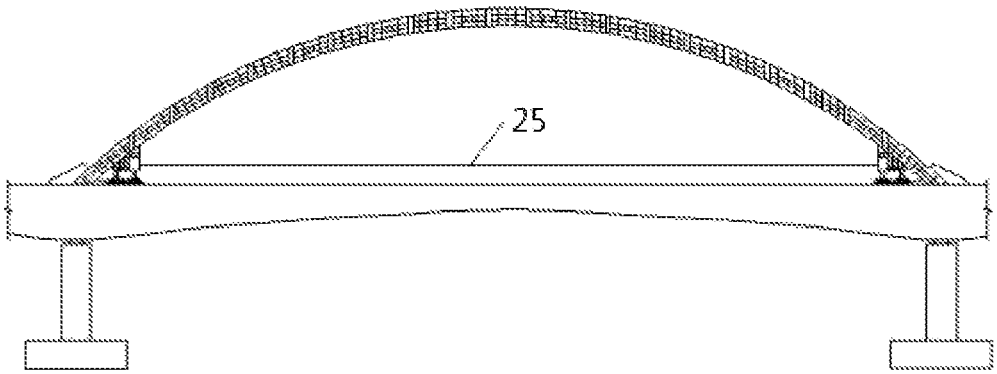
FIG. 9 shows a schematic diagram of the construction of the steel tube arch closure according to the method for installing steel tube arches provided by the disclosure.
Figure 10:
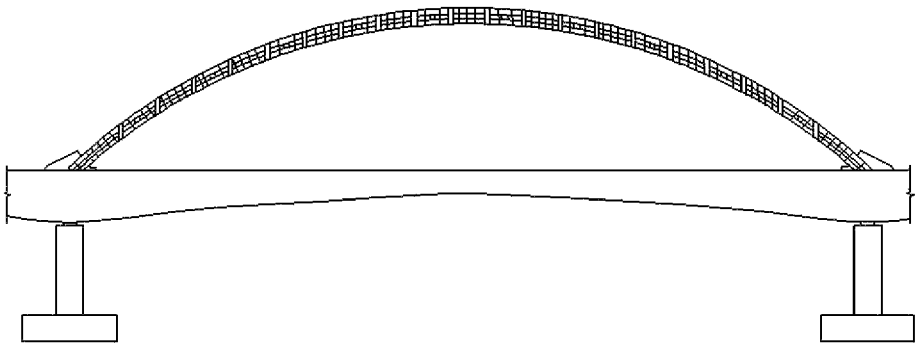
FIG. 10 shows a schematic diagram of the construction of arch falling and temporary auxiliary facilities dismantling according to the method for installing steel tube arches provided by the disclosure.
Figure 11:
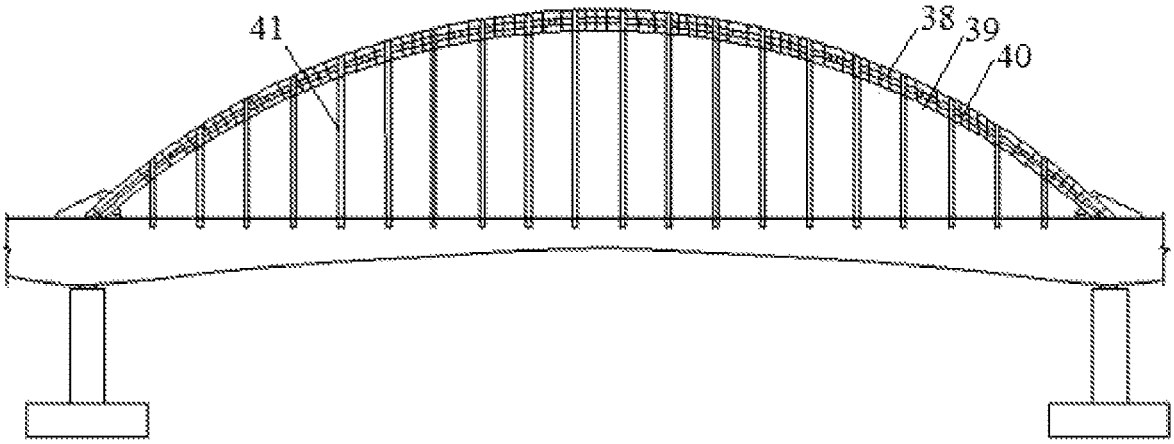
FIG. 11 shows a schematic diagram of the construction of concrete and suspender in the arch according to the method for installing steel tube arches provided by the disclosure.

Referring to FIGS. 1-23, a method for installing steel tube arches comprises the following steps:

Step S1, erecting assembling brackets 261 for steel tube arch of longitudinally moving segment 26, as shown in FIG. 2:

Erecting steel tube arch assembling brackets 261 for a steel tube arch of longitudinally moving segment on the cast-in-place box girders 37 at 32 m between piers on a shore side;

Step S2, assembling the steel tube arch of longitudinally moving segment 26, as shown in FIG. 3:

(1) assembling 26 small steel tube arch segments into 15 segments in the processing plant and assembling the 15 segments into 9 installation segments on site;

(2) installing arch springing longitudinally moving trolleys 106 on both sides of the steel tube arch of longitudinally moving segment 26;

(3) using two 160t truck cranes to symmetrically assemble the installation segments according to the sequence from the arch springing to the vault to complete the steel tube arch of longitudinally moving segment 26;

Step S3, installing temporary tie rods 25, as shown in FIG. 4:

installing temporary tie rods of the steel tube arch of longitudinally moving segment 26 and stretching them to form a temporary tied arch structure;

Step S4, dismantling the assembling brackets 261, as shown in FIG. 5:

(1) using a 50t truck crane to hang the assembling brackets 261 over the bridge deck and removing the assembling brackets 261 symmetrically from the middle to both sides;

(2) in the process of brackets dismantling, monitoring the stress and alignment of the steel tube arch of longitudinally moving segment 26, and properly adjust the tensioning force of the temporary tie rods 25;

Step S5, longitudinally moving the steel tube arch of longitudinally moving segment 26, as shown in FIGS. 6-7:

(1) after the closure of the continuous girder of the main bridge, laying and installing the longitudinally moving track and debugging the longitudinal jack system;

(2) using 4 sets of 50t jacks to smoothly and continuously push the steel tube arch of longitudinally moving segment 26 to the designed lifting position of the main span;

Step S6, erecting arch springing brackets 262 and assembling small mileage arch springing segments 263, as shown in FIG. 8:

(1) using a tower crane to erect small mileage arch springing brackets 262;

(2) pouring arch springing concrete;

Step S7, closing the steel tube arch, as shown in FIG. 9:

(1) continuously measuring the dimension of closure opening;

(2) matching and cutting the steel tube arch of inlaying segment in a back yard according to the measured data;

(3) completing closure construction of the steel tube arch at a closure temperature;

Step S8, arch falling and dismantling temporary auxiliary facilities, as shown in FIG. 10:

unloading temporary tie rods 25 in stages, and dismantling the arch springing longitudinally moving trolleys;

Step S9, construction of concrete and suspenders 41 in the steel tube arch, as shown in FIG. 11:

(1) pumping and injecting arch rib concrete with pressure according to the sequence of the upper chord first 38, then the lower chord 39, then the web plate 40;

(2) installing the long suspender first and then installing the short suspender, and tensioning the suspenders according to the sequence specified in design drawings.

In this embodiment, in the step S2, the overall horizontal length of the longitudinally moving segment is 185.5 m, the axial length is 202.1 m, the height of steel tube arch is 39.2 m, and the assembling height is about 39.2 m; the longitudinally moving segment is divided into 15 segments, the horizontal length of the largest segment is 16.9 m, and the weight of single arch rib is about 26.3t; the specific construction method is as follows:

After the 15 processed segments are transported to site, assemble the processed segments into 9 installation segments in a back yard, the maximum axis length of the installation segment is about 31.7 m and the weight is about 47t; then, using two 160t truck cranes to lift and install the segments, and assembling the segments on the steel tube support on the 4×48 m cast-in-place box girder 37, and the assembling sequence is from both ends to the top.

Figure 24:
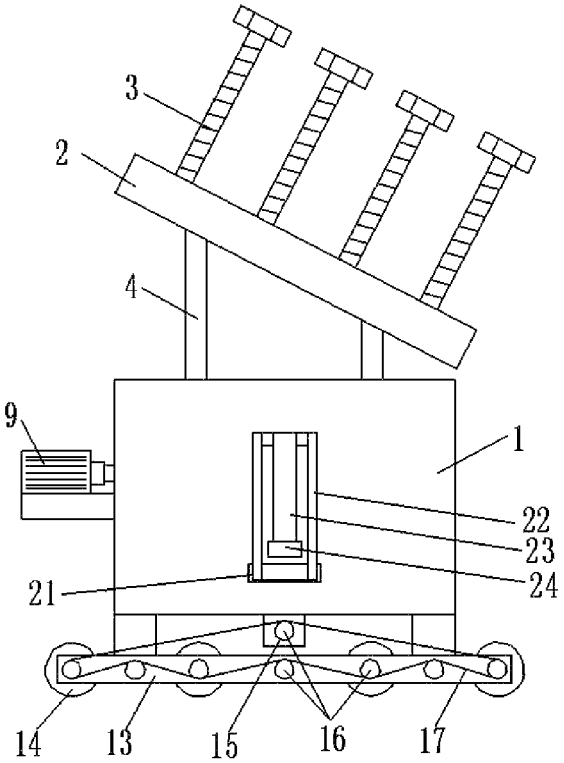
FIG. 24 shows a structural schematic diagram of the arch springing longitudinally moving trolley according to the method for installing steel tube arches provided by the disclosure.
Figure 25:
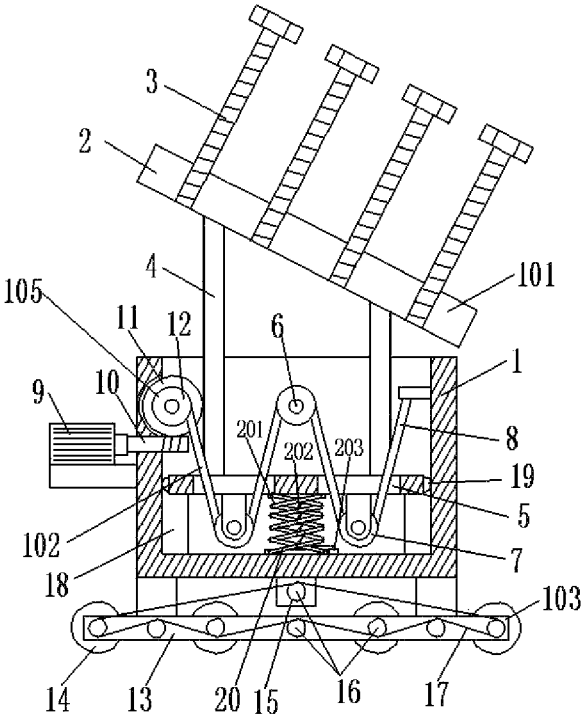
FIG. 25 shows a sectional view of the arch springing longitudinally moving trolley according to the method for installing steel tube arches provided by the disclosure.
Figure 26:
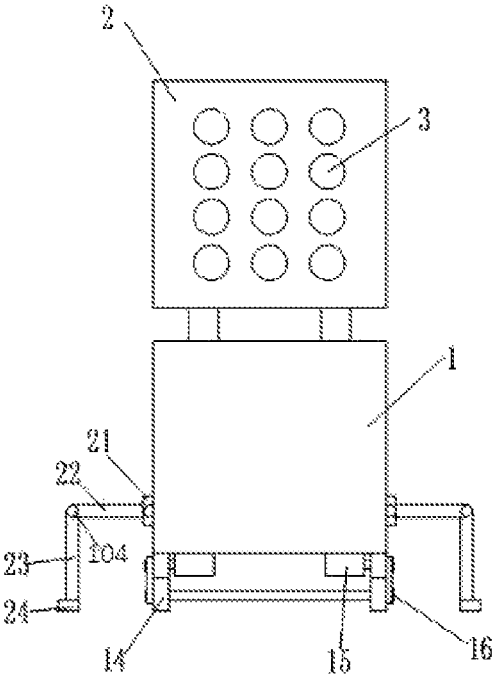
FIG. 26 shows a side view of the arch springing longitudinally moving trolley according to the method for installing steel tube arches provided by the disclosure.

As shown in FIG. 24-26, the arch springing longitudinally moving trolley 106 comprises a vehicle body 1, a supporting device 101 above the vehicle body 1, a lifting device 102 inside the vehicle body 1, a crossed hoisting device 20, a walking device 103 under the vehicle body 1, a drive motor 9 and a servo motor 15, the drive motor 9 drives the lifting device 102 to lift, the lifting device 102 further drives the supporting device 101 to lift to support the arch springing, the crossed hoisting device 20 is used to support the lifting device 102, and the servo motor 15 is used to drive the walking device 103 moving further to drive the vehicle body 1; the lifting device 102 comprises a sliding plate 5, a fixed pulley 6, a movable pulley 7 configured in the vehicle body 1, two ends of the sliding plate 5 are inlaid with balls 19 which are in rolling contact with the inner wall of the vehicle body 1, two ends of the bottom of the sliding plate 5 are fixedly connected with a plurality of brackets 18, and the bottom ends of the brackets 18 are movably abutted with the inner bottom of the vehicle body 1; the fixed pulley 6 is fixedly connected with a top of the inner side of the vehicle body 1, several movable pulleys 7 are fixedly connected with the bottom of the sliding plate 5, and the several movable pulleys 7 and the fixed pulley 6 are wound with an identical steel wire rope 8; one end of the steel wire rope 8 is fixedly connected to the inner wall of the vehicle body 1; the drive motor 9 is connected with the steel wire rope 8 with a power transmission module 105.

The power transmission module 105 comprises a worm 10 fixedly connected with an output shaft of the drive motor 9, a worm gear 11 and a winding reel 12 rotatably connected with an inner top of the vehicle body 1, the winding reel 12 is fixedly connected to a front side of the worm gear 11, and the worm 10 is engaged with the worm gear 11; the other end of the steel wire rope 8 is wound and fixedly connected to the winding reel 12.

The supporting device 101 comprises an inclined frame 2, a top side of the inclined frame 2 is screwed with a plurality of arch springing fixing bolts 3, a bottom of the inclined frame 2 is fixedly connected with a plurality of support rods 4, and bottom ends of the support rods 4 extend to the middle part of the inner side of the vehicle body 1 and are fixedly connected with the sliding plate 5.

The crossed hoisting device 20 comprise a crossed lifting rod 201 and a piston rod 202 arranged on the crossed lifting rod 201; a control power supply 203 is arranged at a bottom of the inner side of the vehicle body 1, and one end of the piston rod 202 is connected with the control power supply 203 through a line; the crossed hoisting device 20 is arranged at the bottom and middle section of the sliding plate 5 and is fixedly connected with the inner bottom of the vehicle body 1.

The walking device 103 comprises a traveling frame 13, the traveling frame 13 is fixedly connected to both sides of the bottom of the vehicle body 1, a plurality of sets of wheels 14 are rotatably connected to the traveling frame 13; the servo motor 15 is fixedly connected to the bottom of the vehicle body 1, sprockets 16 are arranged on the front end of the wheels 14, the front side of the traveling frame 13 and the output shaft of the servo motor 15, and the wheels 14 are coaxially driven with the corresponding sprockets 16; the front side of the travelling frame 13 is rotatably connected with the corresponding sprocket 16; the output shaft of the servo motor 15 is fixedly sleeved with the corresponding sprockets 16, and an identical chain 17 is drivingly connected to a plurality of groups of sprockets 16.

The arch springing longitudinally moving trolley 106 further comprises a stabilizing device 104, the stabilizing device 104 is arranged on the outside of the vehicle body 1, the stabilizing device 104 comprises a fixed base 21 and a balancing rod 22 arranged on the fixed base 21, one end of the balancing rod 22 is movably connected with the fixed base 21, the other end of the balancing rod 22 is movably connected with a fixing rod 23, and one end of the fixing rod 23 is provided with a fixing seat 24. The balancing rod 22 moves circularly around the fixed base 21 and the balancing rod 22 has a zigzag structure, and the fixing rod 23 is placed inside the balancing rod when retracted.

The above-mentioned wheels 14 are laid on the track, which is laid on the pile foundation. The inclined frame 2 is attached to the bottom of the arch springing, and the arch springing is fixed on the inclined frame 2 through the arch springing fixing bolts 3. Then, the drive motor 9 is started, which drives the worm gear 11 and the winding reel 12 to rotate, and the winding reel 12 rotates to wind up the steel wire rope 8. The steel wire rope 8 can lift the sliding plate 5 by pulling the movable pulley 7. The control power supply 203 is started at the same time as the drive motor 9 is started. The control power supply 203 transmits the current to the piston rod 202 through the line, and the piston rod 202 moves to drive the crossed lifting rod 201 to move. The sliding plate 5 lifts the inclined frame 2 and the arch springing through the supporting rod 4 and the crossed hoisting device 20; When the arch springing reaches a predetermined height, the drive motor 9 is stopped, the wire rope 8 will not continue to pull the pulley 7 to make the sliding plate rise, and the crossed hoisting device 20 will also stop working. At this time, the crossed hoisting device 20 that stops working provides support force for the sliding plate 5 and fixes the sliding plate 5 at this height. Then, the servo motor 15 is started and drives a plurality of groups of sprockets 16 to rotate at the same time through the chain 17, and the sprockets 16 drive the wheels 14 to travel on the track, which is convenient for moving the position of the arch springing; when the arch springing is lifted to a predetermined position, the balancing rod 22 in the stabilizing device extends, and then the fixing rod 23 provided on it extends until the fixing seat 24 provided at one end of the fixing rod 23 contacts the ground, so that the vehicle body 1 is balanced and stabilized on the ground.

Figure 16:
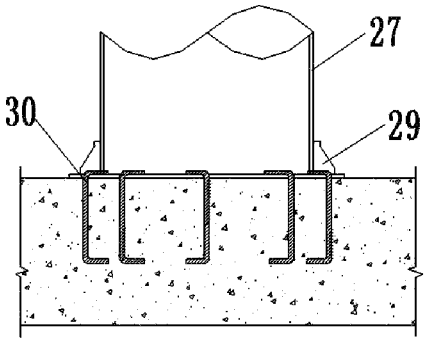
FIG. 16 shows a schematic front view of the fixed structure of the steel tube upright post foundation according to the method for installing steel tube arches provided by the disclosure.
Figure 17:
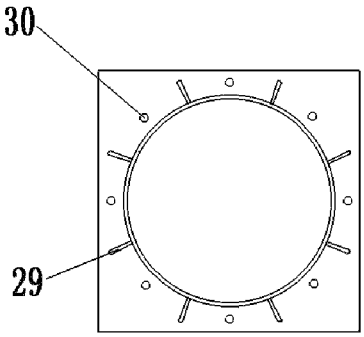
FIG. 17 shows a schematic top view of the fixed structure of the steel tube upright post foundation according to the method for installing steel tube arches provided by the disclosure.

In this embodiment, in the step S1, as shown in FIG. 16-17, a bracket foundation is reliably connected with the girder body, anchor bars are embedded during the construction of the 48 m simply supported girder, a 16 mm bottom plate is arranged at a top to be connected with upright posts 27, 8 anchor bars of 25 mm threaded steel bars 30 are arranged, and bottoms of the anchor bars are connected with the steel bars of the girder body as a whole.

Figure 12:
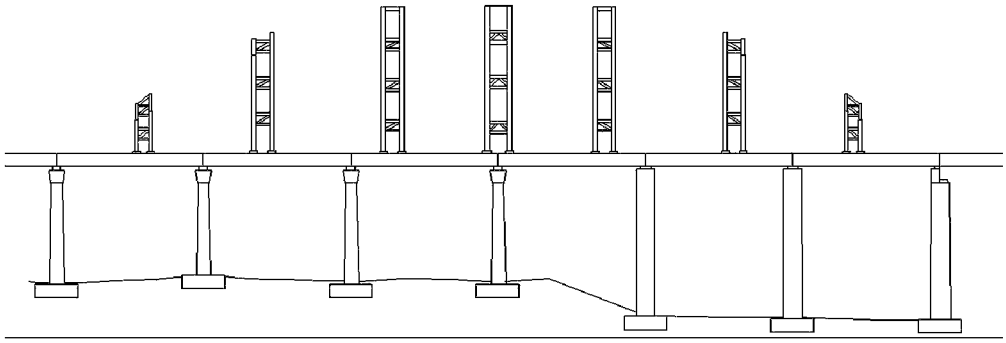
FIG. 12 shows a schematic diagram of the facade layout of the steel tube arch assembling brackets according to the method for installing steel tube arches provided by the disclosure.
Figure 13:
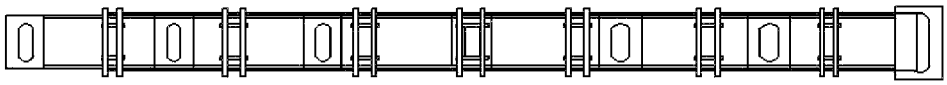
FIG. 13 shows a schematic top view of the steel tube arch assembling brackets according to the method for installing steel tube arches provided by the disclosure.

In this embodiment, in the step S1, as shown in FIG. 12-13, the steel tube arch assembling bracket 261 is arranged on a simply supported box girder 37 bridge deck at a position of 32 m between piers, and 14 rows of steel tubes are symmetrically arranged on the bracket, every two rows of steel tube upright posts 27 are arranged into a group to form a lattice structure, and an space of about 22 m for assembling the steel tube arches 26 is reserved between the two groups, and each steel tube arch installation segment is supported on two groups of brackets.

Figure 14:
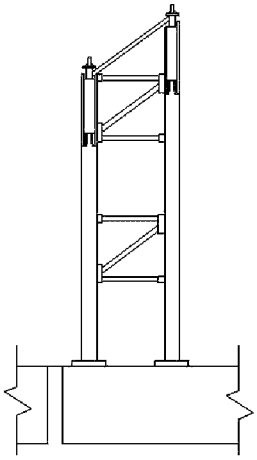
FIG. 14 shows a schematic front view of the structure of the steel tube arch assembling bracket according to the method for installing steel tube arches provided by the disclosure.
Figure 15:
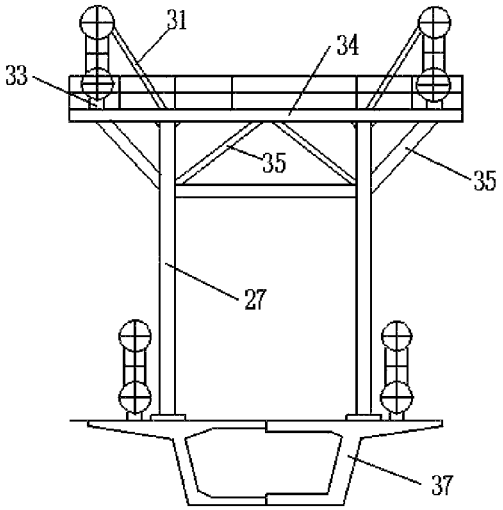
FIG. 15 shows a schematic side view of the structure of the steel tube arch assembling bracket according to the method for installing steel tube arches provided by the disclosure.

In this embodiment, in the step S1, as shown in FIG. 14-15, 800×10 mm steel tubes are used as steel tube upright posts 27, and four steel tubes are arranged in each group, the horizontal spacing of each group of steel tube upright posts 27 is 7.0 m, and the longitudinal spacing is 3.0~5.0 m, HN450×200 mm or 20 profile steel lateral bracings are arranged between the steel tube upright posts 27, and bottoms of the upright posts 27 are welded and fixed with the embedded parts at an upper part of the girder body, tops of each row of steel tube upright posts 27 are provided with double-assembled H450×200 mm profile steels as spandrel girders 34, with overhanging tripods at both ends, the spandrel girders 34 are provided with crescent-shaped steel tube arch tray 33 and steel tube arch braces 31.

In this embodiment, in the step S1, as shown in FIG. 16-17, during construction of cast-in-place box girder 37, 25 anchor bars are embedded on a top of the girder in advance, the anchoring depth of the anchor bars is more than 40 cm, and the anchor bars are connected with the steel bars 30 of the girder as a whole; before the installation of steel tube upright posts 27, a 16 mm thick bottom plate is installed and fixed with M24 sleeves, and steel tube upright posts 27 are welded with the bottom plate, so that a floor and the girder surface are closely attached during construction.

Figure 18:
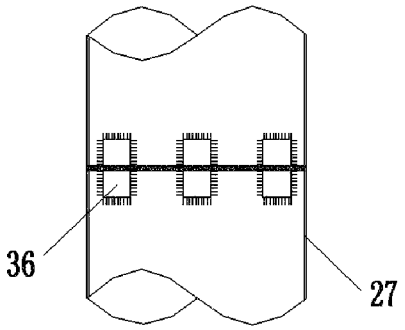
FIG. 18 shows a front view of the structure of the steel tube connection according to the method for installing steel tube arches provided by the disclosure.
Figure 19:
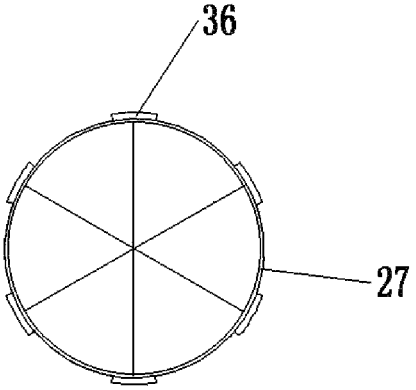
FIG. 19 shows a schematic top view of the structure of the steel tube connection according to the method for installing steel tube arches provided by the disclosure.

In this embodiment, in the step S1, as shown in FIG. 18-19, the steel tube upright posts 27 are processed in a back yard according to a bottom elevation of the steel tube and a top elevation of steel tube upright posts 27; in order to ensure the stability of the steel tube upright posts 27, the steel tube upright posts 27 and lateral bracings should be constructed synchronously, and the installation verticality is less than or equal to H/500 and not more than 5 cm, the extension of the steel tube in a back yard and a front yard are welded by penetration welding, and 6 connecting plates 36 with a thickness of 12 mm are welded on the outside, the dimension of the connecting plates 36 is 300 mm×150 mm×12 mm.

In this embodiment, in the step S1, lateral bracings and diagonal bracings 35 are processed according to drawings in a back yard, and the truck crane and steel tube upright posts 27 are used for synchronous construction on site; before the lateral bracings are hoisted, elevation positions of the lateral bracings are accurately set out according to drawings, and the quality and thickness of welds between the lateral bracings and steel tubes, lateral bracings and diagonal bracings 35 are strictly controlled during construction; all the lateral bracings are connected by full welding, the thickness of the weld shall not be less than the thickness of base metal, and the intersections of the two diagonal bracings 35 shall be welded as a whole; there shall be no defects of pores, slag inclusions, arc pits, cracks and full welding on the weld surface; the next stage of construction can only be carried out after an on-site quality inspector checks and confirms that the welding seam of steel tube pile connection is qualified; the four steel tubes of an identical steel tube lattice column should be constructed synchronously, and it is forbidden to carry out the next vertical steel tube extension operation if the steel tube lateral bracings has not been welded.

Figure 20:
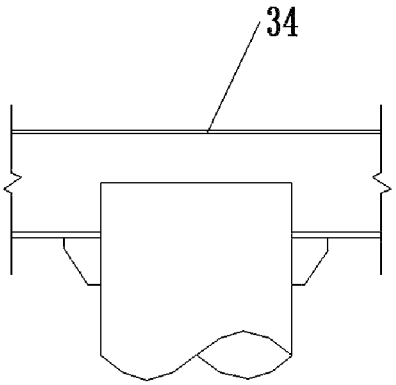
FIG. 20 shows a schematic front view of the corbel at the pile top according to the method for installing steel tube arches provided by the disclosure.
Figure 21:
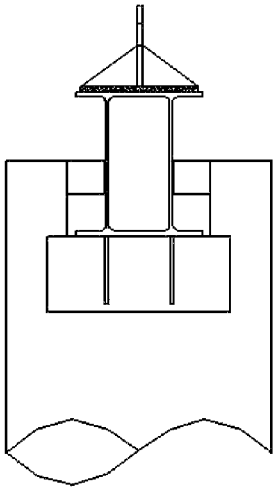
FIG. 21 shows a schematic side view of the corbel at the pile top according to the method for installing steel tube arches provided by the disclosure.

In this embodiment, in the step S1, as shown in FIG. 20-21, spandrel girders 34 are of double-assembled HN450×200 profile steel, and are hoisted on the box girder 37 by a truck crane; before the installation of the spandrel girder 34, pile top notches are cut and bearing corbels are welded on site; elevations of top surfaces of the corbels and the pile top notches are measured and set out, and the elevation and stability of pile corbel surfaces are strictly controlled; skilled workers are arranged to cut notches to ensure that the cutting surfaces of the notches are flat, and the corbels are installed after the notches are cut; elevations of corbel panels are measured accurately, and elevation differences between four corners and the center of the panel is less than 2 mm.

Figure 22:
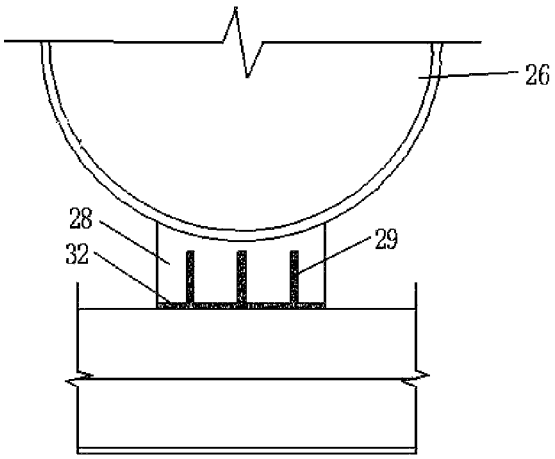
FIG. 22 shows a schematic front view of the structure of the steel tube arch support according to the method for installing steel tube arches provided by the disclosure.
Figure 23:
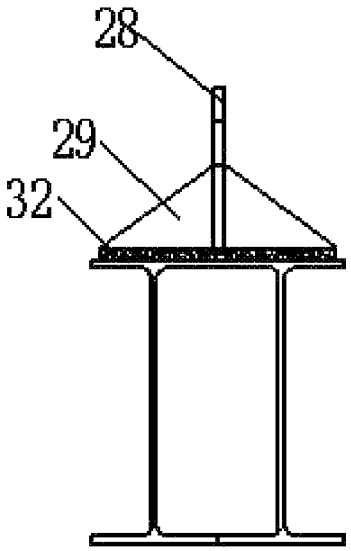
FIG. 23 shows a schematic side view of the structure of steel tube arch support according to the method for installing steel tube arches provided by the disclosure.

In this embodiment, in the step S1, as shown in FIG. 22-23, a crescent-shaped steel tube supporting base device is arranged at a top of the bracket, and the device comprises supporting plates 28, backing plates 32 and stiffening plates 29, wherein the supporting plates are all of 24 mm thick steel plates, and the supporting base is processed and formed in a factory, and fixed and installed on site, and one supporting base is installed at each of both ends of each installation segment.

In the installation process of steel pipe arch, the disclosure uses specialized arch springing longitudinally moving trolleys provided by the embodiment of the disclosure for the installation of steel pipe arch.

According to the method for installing steel tube arches provided by the disclosure, the steel tube arch of the main bridge is divided into three parts: an arch springing segment, an inlaying segment and a longitudinally moving segment, wherein the large mileage side embedded segment of the arch springing segment is embedded in advance, and the small mileage side embedded segment is embedded and arch support constructed after the longitudinally moving segment is longitudinally moved into position. The method of "heterotopic bracket assembly and integral longitudinal movement" is proposed for construction of the steel tube arch. The steel tube arch is directly closed by "matching cutting method" at a predetermined temperature, and in some embodiments of the present disclosure, the specific construction method is as follows:

(1) construction of steel tube arch of longitudinally moving segment: during the construction of continuous girder, the steel tube arch is hung on the steel tube bracket of simply supported box girder of pier by a truck crane, and the steel tube arch is symmetrically assembled from arch springing to vault. After the construction of the continuous girder of the main bridge is completed, the steel tube arch is "integrally moved longitudinally" to the designed closing position through the longitudinal movement system;

(2) construction of steel tube arch of arch springing segment: the steel tube arch of small mileage side arch springing segment is assembled after the steel tube arch of longitudinally moving segment is moved into position, and the steel tube arch of large mileage side can be assembled during the construction of continuous girder of the main bridge. The arch springing segment is assembled in situ by "bracket method" using a truck crane;

(3) construction of the inlaying segment: "matching cutting method" is used for steel tube arch closure, that is, before closure, continuously observe the size of closure opening, match and cut the length of inlaying segment, then directly inlay the inlaying segment at a suitable temperature, and use a clamp plate to temporarily weld and lock it. The construction of the inlaying segment should be carried out when the temperature is relatively stable. Before the closure connection, the arch axis shall be finally adjusted accurately, and the closure connection shall be carried out after it is confirmed to be consistent with the design;

(4) concrete construction in the steel tube arch: after closure of the steel tube arch, concrete in the arch is poured. The arch rib micro-expansive concrete is constructed by pumping lift-up method from low to high. The concrete in the chord pipe is pumped by primary pumping, and the concrete in the web plate is pumped by secondary pumping. The pumping sequence is: first the upper chord pipe, then the lower chord pipe, and then the web plate. The next ring of concrete can be pumped only after the upper ring of concrete reaches 90% of the design strength;

(5) suspender construction: after the concrete strength in the arch meets the requirements, the installation of suspenders shall be carried out according to the principle of first long suspenders and then short suspenders, and the suspenders shall be tensioned by tripping off, and the single-end one-time tensioning process shall be adopted;

The method for installing steel tube arches provided by the disclosure is safe, standardized and reliable, and the construction standard is prone to control. The method reduces the operation difficulty and construction risk of workers, provides high safety, improves the construction efficiency, and is suitable for extended application.

The above are only some embodiments of the disclosure, but the protection scope of the disclosure is not limited to this. Any equivalent substitution or change made by anyone familiar with the technical field according to the technical solution and inventive concept of the disclosure within the technical scope disclosed by the disclosure fall within the protection scope of the disclosure

We claim:

1. A method for installing steel tube arches, comprising the following steps:

step S1, erecting steel tube arch assembling brackets for a steel tube arch of longitudinally moving segment;

step S2, assembling the steel tube arch of longitudinally moving segment;

(1) assembling small steel tube arch segments into installation segments;

(2) installing arch springing longitudinally moving trolleys on both sides of the steel tube arch of longitudinally moving segment;

(3) using two truck cranes to symmetrically assemble the installation segments according to a sequence from arch springing to vault;

step S3, installing temporary tie rods of the steel tube arch of longitudinally moving segment and stretching to form a temporary tied arch structure;

step S4, dismantling the assembling brackets symmetrically from middle to both sides;

step S5, longitudinally moving the steel tube arch of longitudinally moving segment:

(1) after a closure of continuous girder of a main bridge, laying and installing a longitudinally moving track and debugging a longitudinal jack system;

(2) using jacks to smoothly and continuously push the steel tube arch of longitudinally moving segment to a designed lifting position of a main span;

step S6, erecting arch springing brackets and assembling small mileage arch springing segments;

(1) using a tower crane to erect small mileage arch springing brackets;

(2) pouring arch springing concrete;

step S7, closing a steel tube arch:

(1) continuously measuring a dimension of closure opening;

(2) matching and cutting a steel tube arch of inlaying segment according to the measured data;

(3) completing closure construction of the steel tube arch at a closure temperature;

step S8, arch falling, unloading the temporary tie rods in stages, and dismantling the arch springing longitudinally moving trolleys;

step S9, performing construction of concrete and suspenders in the steel arch:

(1) pumping and injecting arch rib concrete with pressure according to a sequence of upper chord first, then lower chord, then web plate;

(2) installing long suspenders first and then installing short suspenders, and tensioning the suspenders.

2. The method for installing steel tube arches according to claim 1, wherein, the arch springing longitudinally moving trolley comprises a vehicle body, a supporting device above the vehicle body, a lifting device inside the vehicle body, a crossed hoisting device, a walking device under the vehicle body, a drive motor and a servo motor, the drive motor drives the lifting device to lift, the lifting device further drives the supporting device to lift to support the arch springing, the crossed hoisting device is used to support the lifting device, and the servo motor is used to drive the walking device moving further to drive the vehicle body;

the lifting device comprises a sliding plate, a fixed pulley, a movable pulley, two ends of the sliding plate are inlaid with balls which are in rolling contact with the inner wall of the vehicle body, two ends of the bottom of the sliding plate are fixedly connected with a plurality of brackets, and the bottom ends of the brackets are movably abutted with the inner bottom of the vehicle body; the fixed pulley is fixedly connected with a top of the inner side of the vehicle body, several movable pulleys are fixedly connected with the bottom of the sliding plate, and the several movable pulleys and the fixed pulley are wound with an identical steel wire rope; one end of the steel wire rope is fixedly connected to the inner wall of the vehicle body; the drive motor is connected with the steel wire rope with a power transmission module.

3. The method for installing steel tube arches according to claim 2, wherein, the arch springing longitudinally moving trolley further comprises a stabilizing device, the stabilizing device is arranged on the outside of the vehicle body, the stabilizing device comprises a fixed base and a balancing rod arranged on the fixed base, one end of the balancing rod is movably connected with the fixed base, the other end of the balancing rod is movably connected with a fixing rod, and one end of the fixing rod is provided with a fixing seat.

4. The method for installing steel tube arches according to claim 2, wherein, the power transmission module comprises a worm fixedly connected with an output shaft of the drive motor, a worm gear and a winding reel rotatably connected with an inner top of the vehicle body, the winding reel is fixedly connected to a front side of the worm gear, and the worm is engaged with the worm gear; the other end of the steel wire rope is wound and fixedly connected to the winding reel.

5. The method for installing steel tube arches according to claim 4, wherein, the supporting device comprises an inclined frame, a top side of the inclined frame is screwed with a plurality of arch springing fixing bolts, a bottom of the inclined frame is fixedly connected with a plurality of support rods, and bottom ends of the support rods extend to the middle part of the inner side of the vehicle body and are fixedly connected with the sliding plate.

6. The method for installing steel tube arches according to claim 5, wherein, the crossed hoisting device comprise a crossed lifting rod and a piston rod arranged on the crossed lifting rod; a control power supply is arranged at a bottom of the inner side of the vehicle body, and one end of the piston rod is connected with the control power supply through a line; the crossed hoisting device is arranged at the bottom and middle section of the sliding plate and is fixedly connected with the inner bottom of the vehicle body.

7. The method for installing steel tube arches according to claim 6, wherein, the walking device comprises a traveling frame, the traveling frame is fixedly connected to both sides of the bottom of the vehicle body, a plurality of sets of wheels are rotatably connected to the traveling frame; the servo motor is fixedly connected to the bottom of the vehicle body, sprockets are arranged on the front end of the wheels, the front side of the traveling frame and the output shaft of the servo motor, and the wheels are coaxially driven with the corresponding sprockets; the front side of the travelling frame is rotatably connected with the corresponding sprocket; the output shaft of the servo motor is fixedly sleeved with the corresponding sprockets, and an identical chain is drivingly connected to a plurality of groups of sprockets.

8. The method for installing steel tube arches according to claim 7, wherein, the arch springing longitudinally moving trolley further comprises a stabilizing device, the stabilizing device is arranged on the outside of the vehicle body, the stabilizing device comprises a fixed base and a balancing rod arranged on the fixed base, one end of the balancing rod is movably connected with the fixed base, the other end of the balancing rod is movably connected with a fixing rod, and one end of the fixing rod is provided with a fixing seat.

9. A method for installing steel tube arches, comprising the following steps:

step S1, erecting steel tube arch assembling brackets for a steel tube arch of longitudinally moving segment;

step S2:

assembling small steel tube arch segments into installation segments;

installing arch springing longitudinally moving trolleys on both sides of the steel tube arch of longitudinally moving segment;

using two truck cranes to symmetrically assemble the installation segments according to a sequence from arch springing to vault;

laying wheels of arch springing longitudinally moving trolleys on a track, the track is laid on pile foundations, attaching inclined frames of the arch springing longitudinally moving trolleys to bottoms of arch springing, and the arch springing is fixed on the inclined frames through arch springing fixing bolts;

lifting sliding plate: starting a drive motor to drive a worm gear and a winding reel to rotate through a worm, the winding reel rotates to wind up a steel wire rope, the steel wire rope lifts the sliding plate by pulling a movable pulley;

lifting the inclined frame and the arch springing: starting a control power supply to transmit current to a piston rod through a line, the piston rod moves to drive a crossed lifting rod to move, the sliding plate lifts the inclined frame and the arch springing through the supporting rod and a crossed hoisting device;

fixing height of the sliding plate: when the arch springing reaches a predetermined height, stopping pulling the movable pulley and the crossed hoisting device;

moving position of the arch springing: starting a servo motor to drive a plurality of groups of sprockets to rotate through a chain, the sprockets further drives the wheels to travel on the track;

fixing the arch springing longitudinally moving trolleys: when the arch springing is lifted to a predetermined position, a balancing rod in a stabilizing device extends, and then a fixing rod provided on it extends until a fixing seat provided at one end of the fixing rod contacts the ground, so that the vehicle body is balanced and stabilized on the ground;

step S3, installing temporary tie rods of the steel tube arch of longitudinally moving segment and stretching to form a temporary tied arch structure;

step S4, dismantling the assembling brackets symmetrically from middle to both sides;

step S5, longitudinally moving the steel tube arch of longitudinally moving segment:

(1) after a closure of continuous girder of a main bridge, laying and installing a longitudinally moving track and debugging a longitudinal jack system;

(2) using jacks to smoothly and continuously push the steel tube arch of longitudinally moving segment to a designed lifting position of a main span;

step S6, erecting arch springing brackets and assembling small mileage arch springing segments;

(1) using a tower crane to erect small mileage arch springing brackets;

(2) pouring arch springing concrete;

step S7, closing a steel tube arch:

(1) continuously measuring a dimension of closure opening;

(2) matching and cutting a steel tube arch of inlaying segment according to the measured data;

(3) completing closure construction of the steel tube arch at a closure temperature;

step S8, arch falling, unloading the temporary tie rods in stages, and dismantling the arch springing longitudinally moving trolleys;

step S9, performing construction of concrete and suspenders in the steel arch:

(1) pumping and injecting arch rib concrete with pressure according to a sequence of upper chord first, then lower chord, then web plate;

(2) installing long suspenders first and then installing short suspenders, and tensioning the suspenders.

10. The method for installing steel tube arches according to claim 9, wherein, the crossed hoisting device comprises the crossed lifting rod and the piston rod, the piston rod is arranged on the crossed lifting rod; also comprises the control power supply, which is arranged at a bottom of an inner side of the vehicle body, and one end of the piston rod is connected with the control power supply through a line, the crossed hoisting device is arranged at the bottom and middle section of the sliding plate and is fixedly connected with an inner bottom of the vehicle body;

the stabilizing device is arranged on the outside of the vehicle body, comprising a fixed base and a balancing rod arranged on the fixed base, one end of the balancing rod is movably connected with the fixed base, the other end of the balancing rod is movably connected with a fixing rod, and one end of the fixing rod is provided with a fixing seat, the balancing rod moves circularly around the fixed base and the balancing rod has a zigzag structure, and the fixing rod is placed inside the balancing rod when retracted.

* * * * *